US005238144A

United States Patent [19]

Kornegay

[11] Patent Number: 5,238,144

[45] Date of Patent: Aug. 24, 1993

[54] PAPER TABLET VENDING MACHINE

[76] Inventor: Bob I. Kornegay, Rte. 3, Box 5323, Crawfordville, Fla. 32327

[21] Appl. No.: 910,710

[22] Filed: Jul. 6, 1992

Related U.S. Application Data

[62] Division of Ser. No. 850,920, Mar. 13, 1992.

[51] Int. Cl.[5] ..... G07F 11/00

[52] U.S. Cl. ..... 221/97; 221/195; 221/213; 221/276; 221/18.3; 194/350

[58] Field of Search ..... 221/210, 213, 214, 195, 221/276, 268, 97; 271/42, 18.3; 194/350

[56] References Cited

U.S. PATENT DOCUMENTS

| | | | |
|---|---|---|---|
| 1,946,183 | 2/1934 | Williamson | 312/51 |
| 2,036,921 | 4/1936 | Christmas | 194/80 |
| 2,197,036 | 4/1940 | Ford | 271/42 |
| 2,501,970 | 3/1950 | Sawitzke | 312/55 |
| 2,522,033 | 9/1950 | Graham | 312/56 |
| 2,576,636 | 11/1951 | Opgenorth | 221/213 |
| 2,701,145 | 2/1955 | Paulas | 221/43 |
| 2,751,112 | 6/1956 | Bierwert | 221/199 |
| 2,819,817 | 1/1958 | MacKenzie et al. | 221/213 |
| 3,279,791 | 10/1966 | Fisher | 271/42 |
| 4,140,243 | 2/1979 | Etes | 221/215 |
| 4,367,826 | 1/1983 | Glaser | 221/213 |
| 4,770,321 | 9/1988 | Anderson | 221/100 |
| 5,137,134 | 8/1992 | La Spina et al. | 221/213 |

*Primary Examiner*—H. Grant Skaggs
*Attorney, Agent, or Firm*—Franklin J. Cona

[57] ABSTRACT

A mechanical vending machine for vending paper tablets or the like, one at a time. The machine comprises a cabinet housing the unvended paper tablets, a tablet delivery apparatus, a coin receptor mechanism for receiving the coins, and a coin box to retain the coins. The coins are deposited in a coin deposit box located in the interior of the cabinet thereof for storage until the service personnel retrieve the coins and restock the paper tablets in the cabinet. The paper tablet vending machine has a simplified design, a low initial cost of manufacture, is easy to install and maintain, is totally independent of an outside power source, and will allow paper tablets to be vended in locations considered impractical because of the operating labor and the power requirements of vending machines heretofore. The machine comprises a cabinet having a top panel, a base, a removable lockable side panel for restocking the machine, and an interior storage tray for storing unvended paper tablets. Further, a front panel of the cabinet has a conventional coin receptor mechanism and a delivery aperture for the person to retrieve the vended paper tablet after inserting the proper amount of coinage and performing a complete vending cycle.

10 Claims, 8 Drawing Sheets 200
208
324
210
218
222
212
204
206
216
202
214
230'
232
228
230
7,8
220
7,8
224
226

208
310
308
306
9
222
206
314
300
210
200
250
c
b
a
240
242
232
304
302
236
234
298
228
D
E
318
320
312
324
220
322
254
272
252
262
270
9
256
268
260
224
258
266
316

PAPER TABLET VENDING MACHINE

BACKGROUND OF THE INVENTION

This application is a division of application Ser. No. 07/850,920 filed Mar. 13, 1992.

FIELD OF THE INVENTION

The present invention relates to a mechanical vending machine. More particularly, this invention relates to a mechanical vending machine for vending paper tablets, one at a time.

DESCRIPTION OF THE BACKGROUND ART

Many coin operated vending machines have been invented over the years for dispensing various articles. Throughout the United States steps are being taken to improve vending machines. Vending machines have been in use for many years for dispensing many different size and shaped articles. The primary advantage of the vending machine is that they do not require the presence of an operator and hence reduce the cost of delivering the article to the consumer. The consumer merely inserts the proper coinage in the machine and self-operates the mechanism to have the desired product dispensed. The primary responsibility the owner of the vending machine has is to service and refill the machine on a periodic basis and to remove the coins deposited therein in exchange for the vended merchandise.

The invention described herein is a vending machine to vend a paper tablet, one at a time, typically used in schools. The invention has great utility in schools or any other place where paper tablets might be needed on the spur of the moment. Airports, bus stations and other places where the public gathers are appropriate locations for the invention. The invention requires no sales labor at all.

Therefore the invention has a significant economic benefit over purchasing a pencil from a retail clerk in a retail setting.

The invention stores twice the amount of product as previous machines stored. This reduces the service labor by increasing the interval between service to restock the invention.

Further, the invention requires no outside sources of power, either electric or pneumatic in order to function. Therefore, the operating costs of the invention are extremely low. The only operating cost associated with the invention is the service labor to collect the coins from the coin deposit box and to restock the paper tablets in the storage hopper inside the cabinet.

Many machines have been developed in the past to vend newspapers, magazines or the like.

Pat. No. 2,819,817 issued to MacKenzie discloses a newspaper or magazine vending machine which includes a vertically oriented, horizontally moveable actuating bar. At the lower end of the actuating bar is a spike and a roller mechanism.

Pat. No. 2,501,970 issued to Sawitzke discloses a newspaper vending machine. The vending machine includes a reciprocally movable newspaper ejector.

Pat. No. 2,522,033 issued to Graham discloses a vending machine with a horizontally moveable shoe to facilitate the dispensing of a newspaper.

Pat. No. 1,946,183 issued to Williamson discloses a vending machine for stacked articles such as tablets, flat packages and papers or the like with the article to be dispensed is disposed in a container above the vending chute.

Pat. No. 2,751,112 issued to Bierwert discloses a vending machine for paper and pencil products in two separate containers joined together for simultaneous Vending from the respective cabinets.

Pat. No. 4,367,826 issued to Glaser discloses a apparatus for dispensing a flat rectangular article from the top of a stack, the stack of articles being disposed downwardly from the coin mechanism and the ejection chute.

Pat. No. 4,140,243 issued to Etes discloses a vending machine with a mechanism for preventing elevation of the stacked newspapers to prevent unauthorized withdrawal of the newspapers or the magazines or the other flat articles. The dispensing mechanism is located in an upwardly disposed compartment and the newspapers or magazines are located in a lower compartment.

Pat. No. 2,036,921 issued to Christmas discloses a coin vending machine for dispensing stackable merchandise which is visible for observation from the observers vantage point.

Pat. No. 2,702,145 issued to Paulus discloses an apparatus for storing and dispensing a supply of stacked flat photo-sensitive paper sheets in a light proof dispensing container, and including a manipulatable dispensing mechanism for engaging the top sheet of the stored stack and ejecting the engaged sheet through a discharge outlet or mouth.

Pat. No. 4,770,321 issued to Anderson discloses a dispensing machine for magazines and newspapers. The vended product to be dispensed is located downwardly from the door access mechanism, being activated by a standard coin vending mechanism.

None of these previous efforts, however, provide the benefits attendant with the present invention. Additionally, prior techniques do not suggest, the present inventive combination of component elements as disclosed and claimed herein. The present invention achieves its intended purposes, objectives and advantages over the prior art devices through a new, useful and unobvious combination of component elements, which is simple to use, with the utilization of a minimum number of functioning parts, at a reasonable cost to manufacture, assemble, test and by employing only readily available materials. Further, the present invention requires no outside source of power whatsoever to function.

It is an object of the invention to provide a vending machine that is easily maintainable in the field by service personnel with a minimum of mechanical skills.

A further object of the invention to provide a vending machine with storage capacity for a large number of tablets to reduce the frequency of service for reloading new merchandise.

It is a still further object of the invention to provide a machine for vending the paper tablet one at a time in a manner to prevent jamming therein.

A still further object of the invention is to provide a vending machine that discourages theft of the unvended merchandise and the unauthorized removal of the coins contained therein.

A still further important object of the invention to provide a vending machine that is not dependent on any external power source to have the product vended.

It is a final object of the invention to provide a vending machine that is dependent upon gravity alone to deliver the vended product to the purchaser.

Although there have been many inventions relating to mechanical vending machine for vending flat stacked articles, none of the inventions have become sufficiently compact, low cost and reliable enough to become commonly used. The present invention meets the requirements of a simplified design, low initial cost, low operating cost, ease of installation and maintainability, and independent of an outside power source.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing the invention, the invention comprises a system to vend paper tablets. More particularly, the invention comprises a cabinet having a stepped front panel, a top panel, a rear panel, a left side panel, a right side panel, and a base. The right side panel has a lockable, removable door for allowing restocking of the paper tablets in the interior of the cabinet. The invention also has a coin receptor in an upper portion of the front panel for receiving coins to initiate the vending of a paper tablet. The tablet is retrieved through an aperture in the lower potion of the front panel by the person who initiated the vending cycle. A coin box shelf is rigidly attached to an upper portion of the front panel and holds a rectangular removable coin box. Further, the inner side of the upper portion of the front panel has a tablet guide panel rigidly attached below the coin box shelf for deflecting the vended paper tablet towards the tablet vending aperture. The coin box retains the vended coins received during the vending cycle. The paper tablet drops onto a tablet delivery tray which has an upper shelf oriented horizontally in the lower portion of the cabinet, and is rigidly attached to the interior wall of the rear panel and the left side panel. Vended paper tablets are stored in a stack on the tablet delivery tray. The vended paper tablet is removed from the top of the unvended stack of tablets on the tablet delivery tray and proceeds down an inclined shelf to a lower shelf oriented horizontally in the lower portion of the cabinet. The lower shelf is rigidly attached to the interior wall of the front panel behind the aperture and the left side panel for retrieval of the vended tablet by the person initiating the vending cycle.

The invention has a tablet dispensing controller which controls the interaction between the coin receptor and the tablet delivery tray.

The coin receptor is located in an upper portion of the front panel and has a conventional flat elongate shape for receiving the coins in the interior section of the receptor prior to initiating the vending cycle. A spring mechanism which is internally disposed within the cabinet has a first end connected to the rearward corner of the cabinet and a second end coupled to the interior end of the coin receptor. When the vended cycle is initiated, the spring mechanism assists the coin receptor in its rearward travel. The invention has a tablet dispensing controller which acts upon the stacked unvended tablets on the upper tray when a coin is placed in the coin receptor and the vending cycle is initiated. The tablet dispensing control means is located in the interior of the cabinet and has a plurality of vertically oriented angular telescopic tubes that act upon the stack of unvended tablets and dispenses one tablet at a time per vending cycle.

The major advantage of the invention over the prior art is in the fact that the invention is extremely simple to manufacture and maintain. The invention utilizes conventional coin receptor mechanisms. Further, many of the mechanical components within the machine itself are readily available off the shelf hardware items, such as the telescopic tubes in the tablet controller. The balance of the machine is fabricated of metal, preferably sheet metal.

A second advantage of the invention is that is entirely mechanical and requires no outside sources of electrical or pneumatic power to function. The simplicity of the invention precludes any great amount of maintenance and should it be necessary, the maintenance can be preformed easily in the field by someone who possesses a minimum of mechanical skills.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which FIGS. 1 through 5 disclose the pencil vending machine and FIGS. 6 through 10 disclose the paper tablet vending machine.

Similar reference characters refer to similar parts throughout the several views of the drawings.

DETAILED DESCRIPTION OF THE PREFERRED EMBODIMENT

Figure 1:
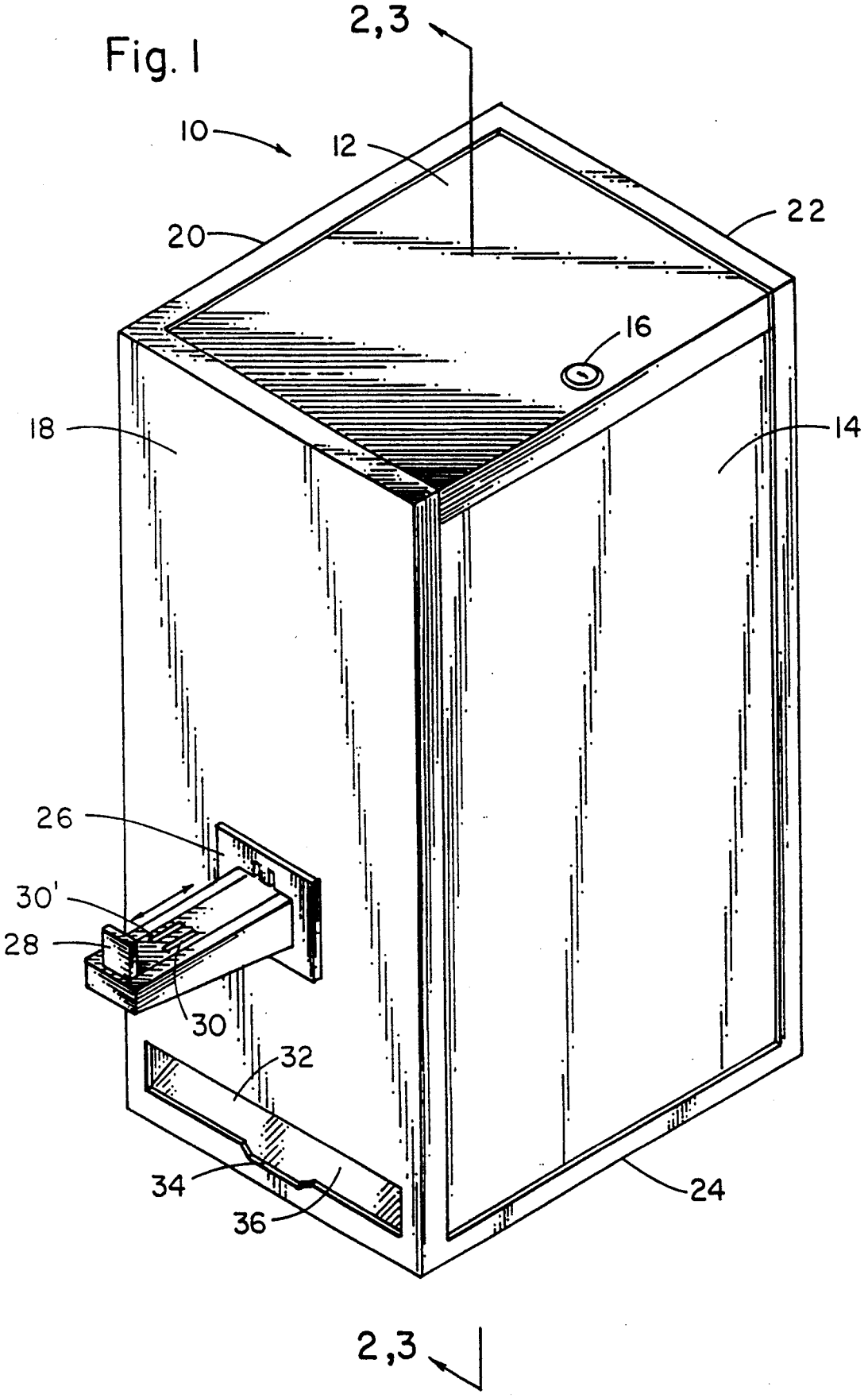
FIG. 1 is a perspective view of the pencil vending machine.

Referring to FIG. 1, the invention is comprised of a cabinet 10 having a removable top panel 12 and a removable right side panel 14. The top panel 12 has a lockable latch 16. The cabinet 10 also has a front panel 18, a left side panel 20, a rear panel 22, and a base 24. The cabinet 10 is fabricated completely of metal, preferably sheet metal.

The front panel 18 has a conventional coin receptor mechanism 26 with a slidable handle 28 and receptor slots 30, 30' adapted to receive a plurality of coins. It should be noted that if only one coin is required, the receptor slots 30, 30' can be modified to receive only one coin. The front panel 18 has a pencil delivery aperture 32 with a finger slot 34 in the bottom thereof through which to grasp the vended pencil. A downwardly inclined shelf 36 in the bottom interior portion 38 of the cabinet 10 has an end 40 rigidly attached to the front panel 18 and a second end rigidly attached to the rear panel 22 for delivering the vended pencil forward to the pencil delivery aperture 32.

Figure 2:
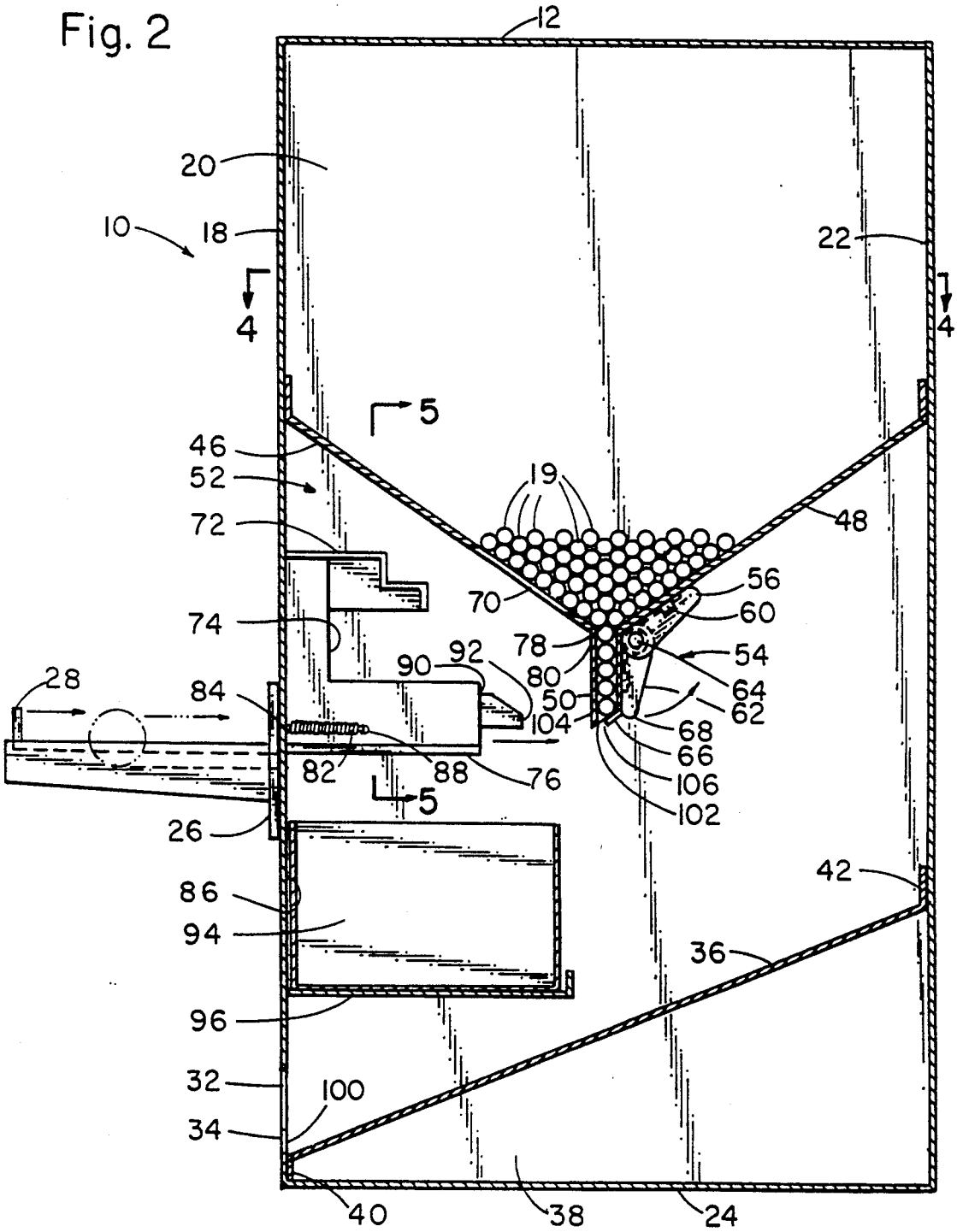
FIG. 2 is a vertical cross section taken along the lines 2—2 of FIG. 1 with the invention in a ready-to-vend status.
Figure 3:
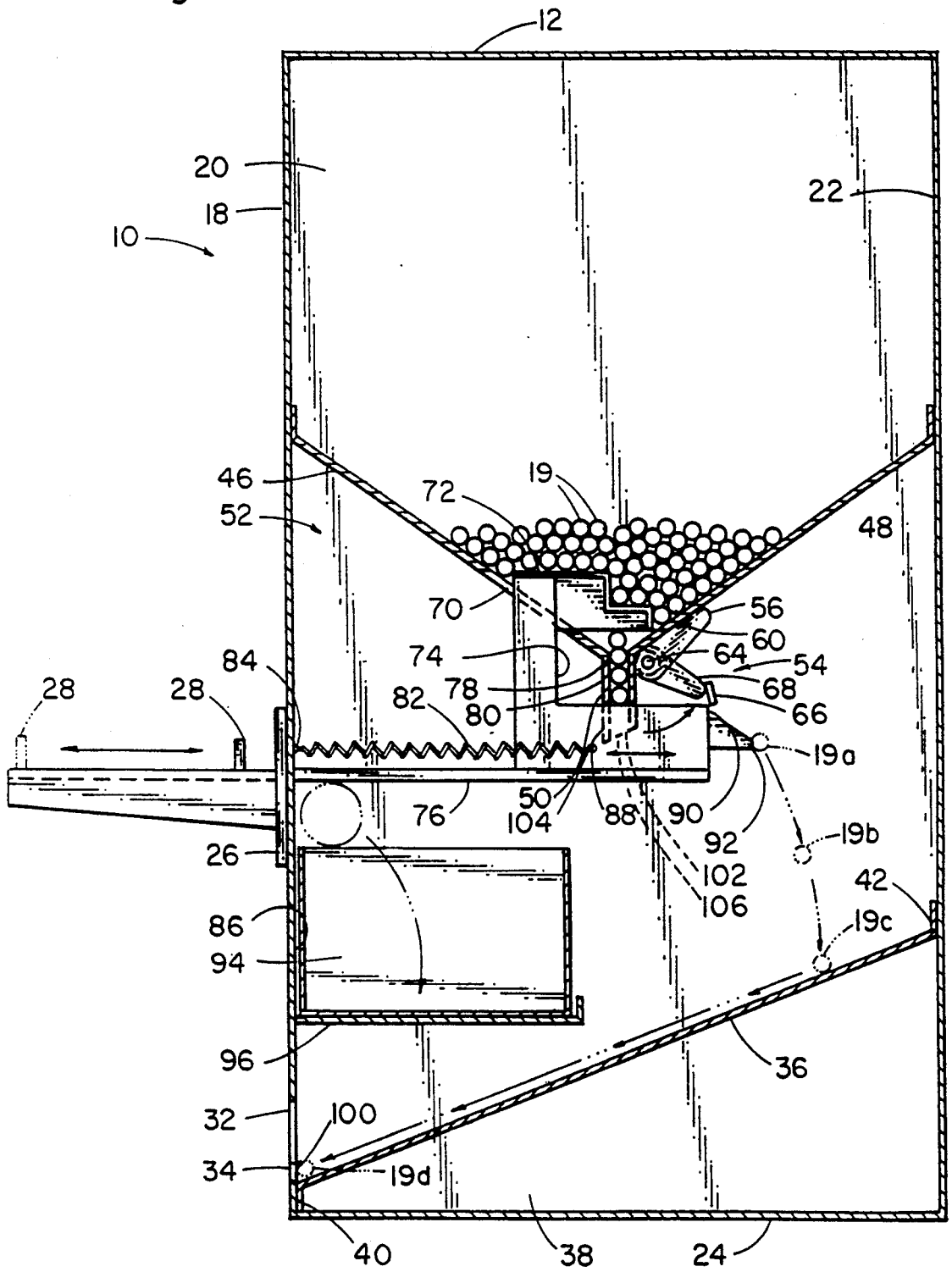
FIG. 3 is a similar cross section taken along the lines 3—3 of FIG. 1 with the invention in a in-process vending status.
Figure 4:
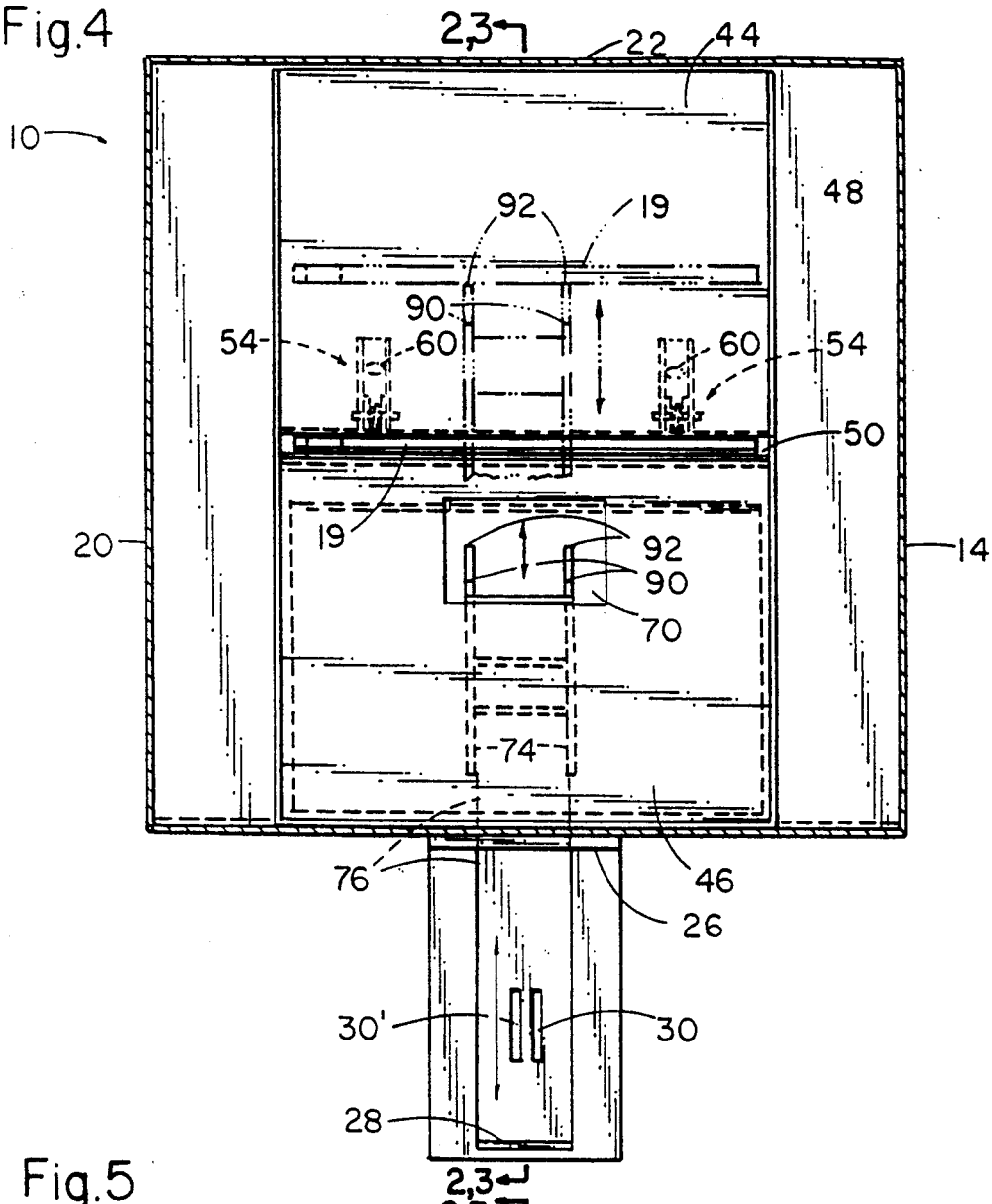
FIG. 4 is a top view of the invention taken along the lines 4—4 of FIG. 2.
Figure 5:
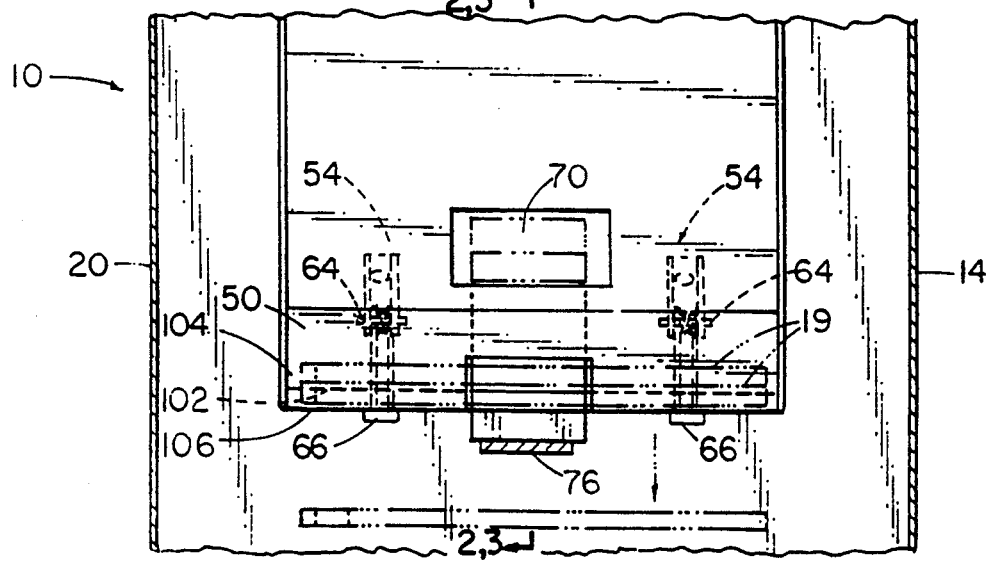
FIG. 5 is a front sectional view taken along the lines 5—5 of FIG. 2.

Referring to FIGS. 2 and 3, but more particularly to FIG. 2, an interior storage hopper 44 with a front sloped storage tray 46, a rear sloped storage tray 48 and a transverse collating chute 50 therebetween is positioned in the upper interior portion 52 of the cabinet 10. The transverse collating chute 50 is adapted to urge the pencils into a single line sequential file to be vended one at a time. The rear sloped storage tray 48 has a plurality of spring biased gates 54 on the underside thereof. Each gate has an upper portion 56 fastened to the underside of the rear sloped pencil storage tray 58 by fasteners 60, preferably by rivets or screws, a bottom portion 62 free to pivot rearwardly and a torsion shaft 64 therebetween. A retention arm 66 is rigidly attached and obliquely disposed to a lower end 68 of the bottom portion 62 of each gate 54 for retaining the unvended pencils in the transverse chute 50.

The front sloped storage tray 46 has a rectangular aperture 70 adapted to receive an agitator block 72 which is attached to an "L" shaped pushblock 74. The "L" shaped pushblock 74 is attached to an interior portion 76 of the slidable handle 28. The agitator block 72 has a stepped cross-sectional configuration for entering the rectangular aperture 70 in the interior storage hopper 44 above the chute 50 and realigning the unvended pencils for sequential single file entry into an entry aperture 78 in an upper portion 80 of the chute 50. A plurality of control springs 82 each having an end 84 attached to the innerside of the front panel 86 and a second end 88 rigidly attached to the "L" shaped pushblock 74 are in spring tension communication for urging the return of the "L" shaped pushblock 74 to a ready-to-vend status. The innerside of the "L" shaped pushblock 90 has a plurality of pencil pushrods 92 rigidly attached for pushing the single vended pencil rearward while retaining the other unvended pencils in the chute 50, precluding their escape as the single pencil is dispensed. The bottom portion 62 of each gate 54 is pivoted rearwardly to allow one pencil to drop out of the chute 50 onto the inclined shelf 36 as the slidable handle 28 is pushed rearwardly. As best seen in FIG. 3, the slidable handle 28 is slid rearwardly to complete the vending of the pencil and also stretches the control springs 82 to bias the "L" shaped pushblock 74 to return to a ready-to-vend status.

When the slidable handle 28 is released by the person, the control springs 82 urge the "L" shaped pushblock 74 forwardly to the front, positioning the invention for another cycle. In the meantime, the coin drops into a coin deposit box 94. The coin deposit box 94 rests on a plate 96 rigidly attached to the innerside of the front panel 86. It should be noted in FIG. 3 that as the pencil pushrods 92 contact the lowermost pencil, it pushes the pencil rearwardly. The pencil does not stay attached to the pencil pushrods 92 as shown in FIG. 3. The purpose of FIG. 3 is to illustrate the path of the vended pencil during the vending cycle. The pencil is pushed rearwardly and likewise the subsequent pencil location indicators show the path of the vended pencil as it drops onto the inclined shelf 36 leading to the pencil delivery aperture 32. The vended pencil is retained at the pencil delivery aperture 32 by an edge 98 of the front panel 18 slightly above a forward edge 100 of the inclined shelf 36.

The agitator block 72 agitates the pencils during the vending process and maintains the remaining supply of unvended pencils in a parallel and aligned relationship within the interior storage hopper 44 to urge continued falling in a sequential manner into the transverse collating chute 50. This can best be seen in FIG. 3. A notched aperture 102 in a lower portion 104 of the chute 50 is adapted to receive the pencil pushrods 92 and allow the pencil pushrods 92 to pass through the chute 50 and shove one pencil rearwardly out of the bottom 106 of the chute 50 onto the inclined shelf 36.

An inner portion 75 of the slidable handle 28 is rigidly attached to the "L" shaped pushblock 74. As best seen in FIGS. 2 and 3, when a coin is inserted into the slot 30 of the coin receptor 26 and pushed rearwardly, the slidable handle 28 travels approximately four inches to allow the pencil pushrods 92 to release one pencil, while the agitator block 72 on the "L" shaped pushblock 74 enters the rectangular aperture 70 in the interior storage hopper 44 and agitates the unvended pencils to that they remain parallel and aligned to the chute 50 at all times. This design allows over seven gross of pencils to be laid into the interior storage hopper 44. Previous inventions only dispensed about three gross of pencils between service intervals. This allows the service person to come around less frequently to refill the invention. As the pencil pushrods 92 shove one pencil out of the bottom 106 of the chute 50, the lower portion 62 of each spring biased gate 54 pivots out of the way while retaining the balance of the pencils within the chute 50, and returns as the fully biased control springs 82 urge the "L" shaped pushblock 74 to return forwardly to a ready-to-vend status, thus preparing the machine for the next cycle.

Also disclosed is a paper table vending machine 200 that can be installed adjacent tot he pencil vending machine 10. The advantages of the paper tablet vending machine 200 over the prior art is it is extremely simple in design and fabrication. The paper tablet vending machine 200 utilizes a conventional coin receptor 202 with modifications. The paper tablet vending machine 200 is very simply and easily manufactured and can be maintained by a person with a minimum of mechanical ability. The paper tablet vending machine 200 requires to electricity and can be installed in remote locations where electric power is unavailable.

Figure 6:
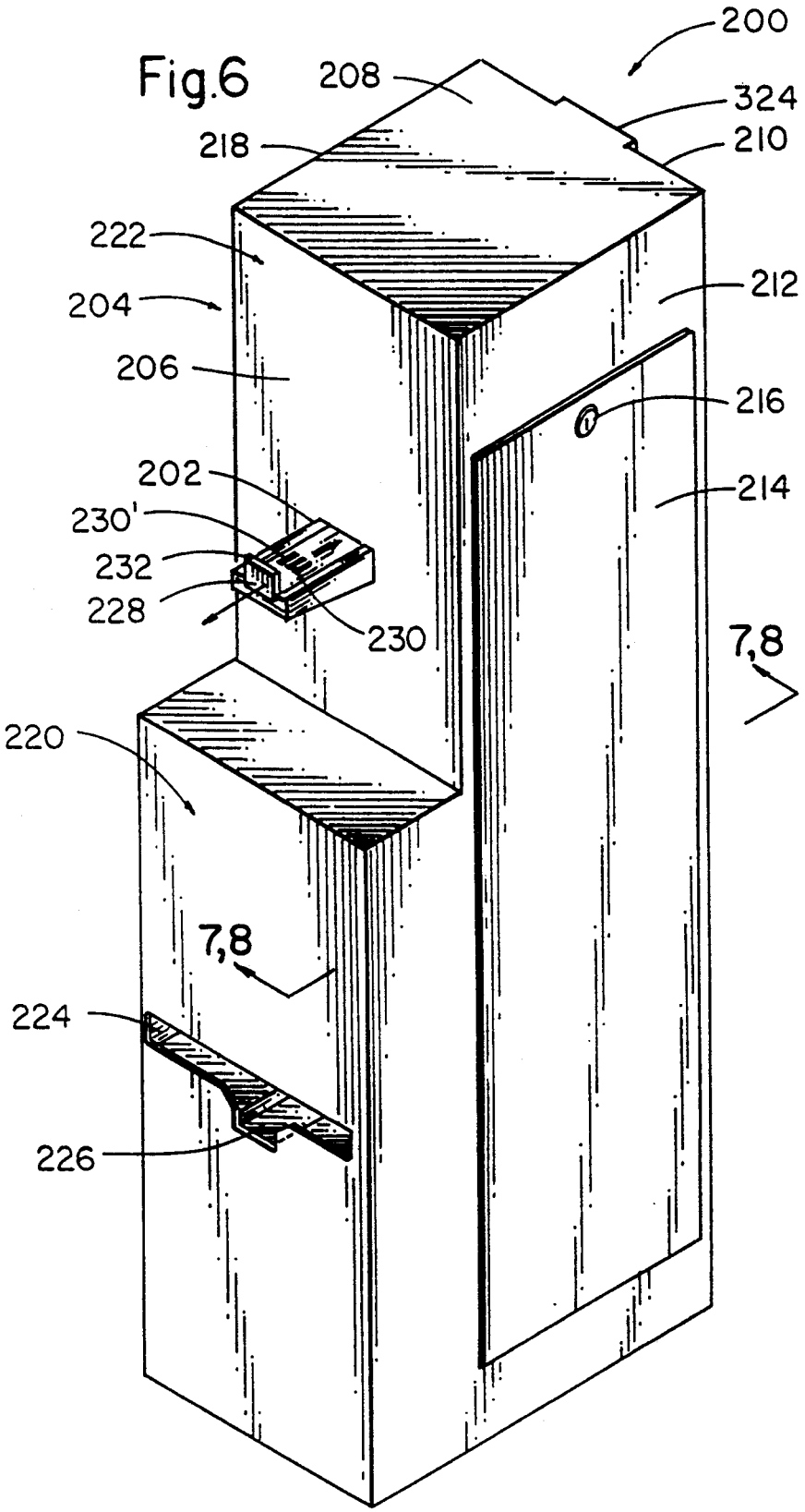
FIG. 6 is a perspective of the paper tablet vending machine invention.

Referring specifically to FIG. 6, the paper tablet vending machine 200 is comprised of a cabinet 204 having a front panel 206, a top panel 208, a rear panel 210, a right side panel 212 with a removable door 214 and a lockable ledge 216, and a left side panel 218. The cabinet 204 is fabricated entirely from metal, preferably sheet metal. The front panel 206 has a lower section 220 and an upper section 222 in a stepped relationship with the lower section 220 having a tablet receiving aperture 224 and a finger aperture 226 for claiming the vended tablet. The conventional coin receptor 202 is located in the upper section 222 and has a slidable handle 228 with a plurality of coin slots 230, 230' and an upwardly projecting end 232 on an outer end of the handle 228. The coin receptor 202 is adapted to allow the slidable handle 228 to be pulled out beyond an outer edge 234 of the coin receptor 202. A notched aperture 236 in a front face 238 of the coin receptor 202 allows the upwardly projecting end 232 to extend beyond the outer edge 234 of the coin receptor 202.

The slidable handle 228 of the coin receptor 202 has an interior section 240 fastened to a piece of flat bar stock 242 having a first end 244 with fasteners 246, preferably rivets or screws, the flat bar stock 242 having a half-twist configuration and having a second end 248 rigidly attached to a tablet controller 250.

A tablet delivery slide 252 for storing and vending paper tablets is located in the bottom section 254 of the cabinet 204. The tablet delivery slide 252 has an upper shelf 256 horizontally oriented for storing a plurality of ready-to-vend tablets in a stacked relationship, a lower shelf 258 horizontally disposed adjacent to the tablet receiving aperture 224 for holding the individually vended tablet, and an inclined shelf 260 therebetween. A vertically oriented guide rail 262 is attached to an edge 264 of the tablet delivery slide 252 for urging the vended tablet to remain on the tablet delivery slide 252 during the vending cycle. The tablet delivery slide 252 has an end 266 rigidly attached to an innerside 268 of the front panel 206 and a second end 270 rigidly attached to an innerside 272 of the rear panel 210 rear panel. The vertical guide rail 262 keeps the vended tablet on the tablet delivery slide 256 during the vending cycle.

The tablet controller 250 has a plurality of rectangular tubes oriented in a telescopic relationship with each other. The tablet controller 250 having an outer tube 274 vertically disposed, and within the outer tube 274 an intermediate tube 276 with a stop 278 rigidly attached at a top end 280, and within the intermediate tube 276, an innermost tube 282. The innermost tube 286 has a lower portion 284 having a tablet gripper tube 286 with a downwardly disposed hook 288 for engaging an edge of the topmost tablet during a vending cycle and a lower end 290 having an arcuate shaped cam follower 292 downwardly disposed for riding side-to-side on the top of the stack of unvended tablet.

The tablet controller 250 is at all times slidably mounted on the stack of tablets so that the arcuate shaped cam follower 292 is free to ride side-to-side horizontally on the stack of tablets. Likewise, the innermost tube 284 is free to ride up and down on the stack of tablets within the intermediate tube 276. The innermost tube 284 has an aperture 294 adapted to threadably receive a limit screw 296 to engage a lower edge 298 of the intermediate tube 276 when the innermost tube 284 is raised to a minimum point when a full load of tablets is loaded on the upper shelf 256 of the tablet delivery slide 252.

Figure 7:
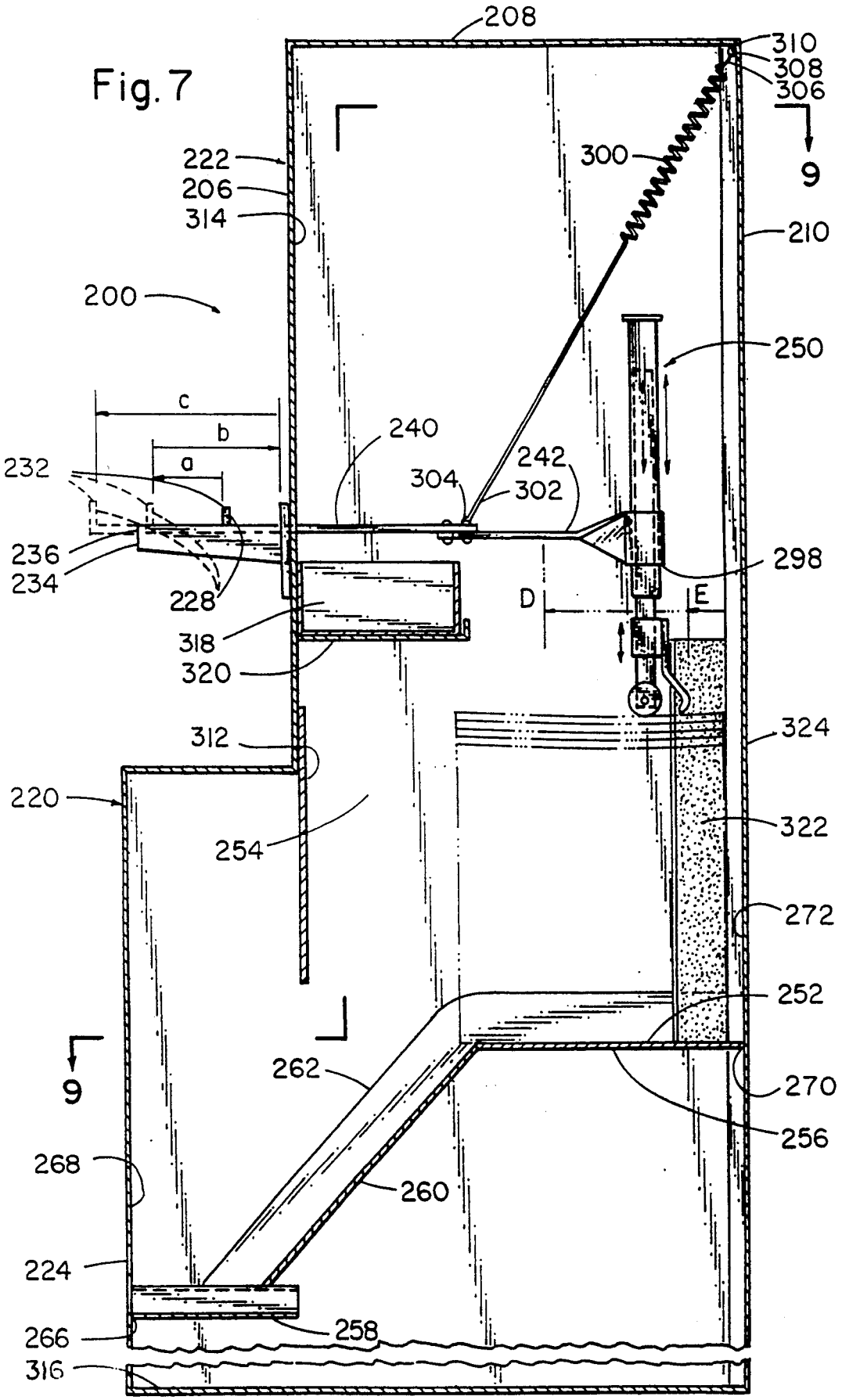
FIG. 7 is a vertical cross section showing the relative horizontal position of the moving parts of the paper tablet vending machine invention taken along the lines 7—7 in FIG. 6.

The hook 288 on the tablet gripper tube 286 is designed to engage a rearmost binding edge of the topmost tablet for vending when operated by the proper amount of coins. FIG. 7 shows the invention in its ready-to-vend status before receiving a coin. A spring biased wire 300 has a first end 302 attached to an aperture 304 in the interior portion 240 of the sliding handle 228 and a second end 306 is attached to an eyelet 308 fastened to an upper corner 310 of the cabinet 204 for urging completion of the vending cycle.

A tablet guide plate 312 is rigidly attached to the innerside 314 of the upper front panel 222 and deflects the vended tablet downwardly onto the inclined shelf 260 as it slides off the top of the stack of tablets. Additional tablets are stored on a base 316 under the upper shelf 256. As the supply of tablets diminishes, service personnel can retrieve the tablets from the base 316 below the upper shelf 256 and stack them on the upper shelf 256 for future vending.

As best seen on FIG. 7, the coin receptor 202 is shown with the slidable handle 228 in solid lines at the ready-to-vend status. The leftward arrow "a" indicates the slidable handle 228 being pulled forwardly to a position where a coin can be inserted. The rightward arrow "b" indicates the slidable handle 228 being slid rearwardly and the tablet controller 250 being slid rearwardly to the rear of the stacked tablets where the hook 288 engages the rearmost edge of the topmost tablet. Then the slidable handle 228 is pulled forwardly as indicated by the "c" arrow beyond the outer edge 234 of the coin receptor 202. This allows the topmost tablet which is in vendable communication with the hook 288 to move forward to a point where it is deflected downwardly by the tablet guide plate 312 and falls onto the inclined shelf 260. This can best be seen in FIG. 8.

Figure 8:
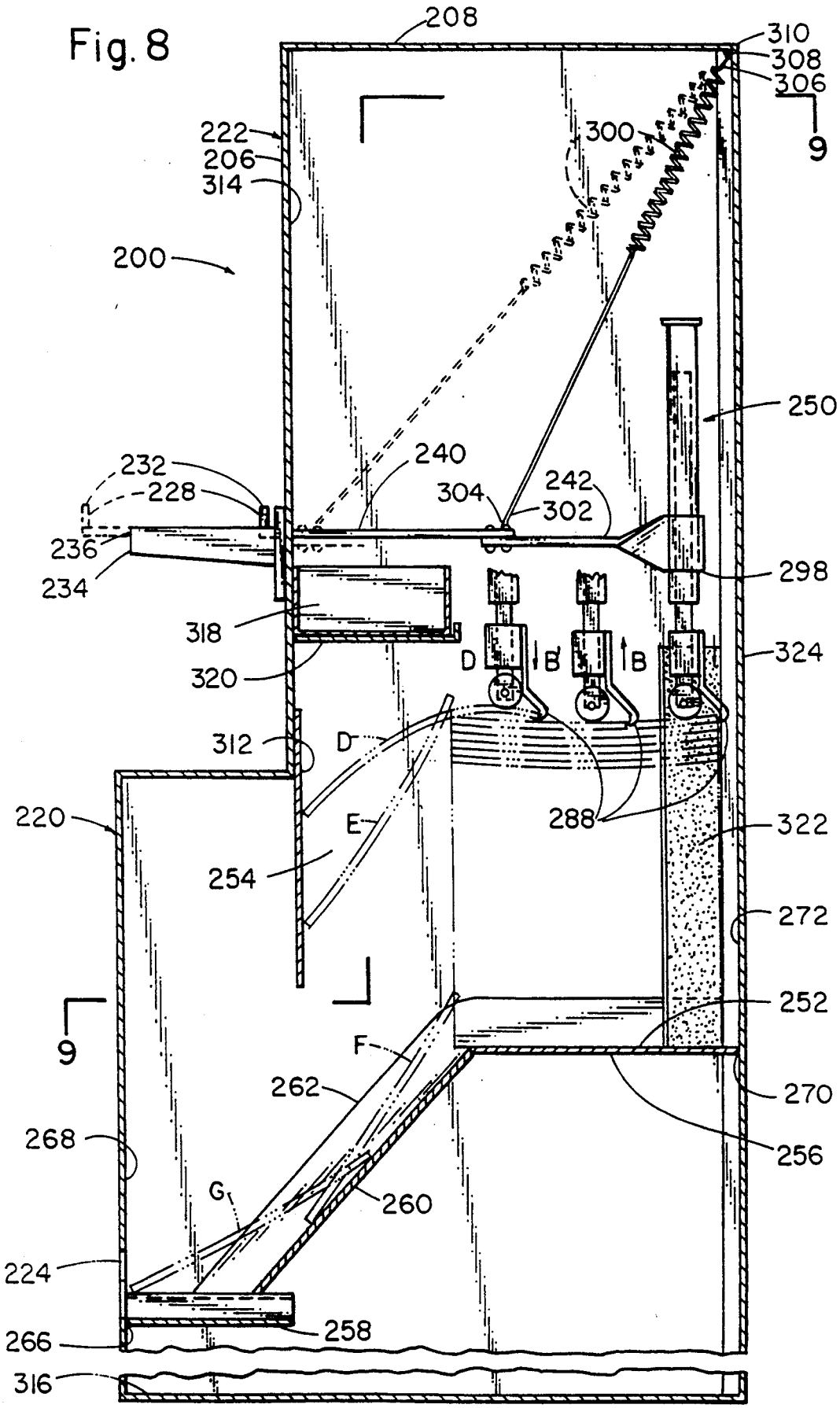
FIG. 8 is a similar cross section showing the movement of the vended tablet taken along the lines 8—8 of FIG. 6.

FIG. 8 discloses the three different positions of the hook 288 during the vending cycle. The "B" position of the paper tablet gripper tube 286 indicates the position of the hook 288 at the rear of the stacked paper tablets in the in-process vending status. The primary position for hooking a paper tablet is shown at "B" with the hook 288 having slipped down to engage the rearmost edge of the uppermost tablet. Position "B'" indicates the hook 288 traversing the top of the stacked to an approximate mid-point and the belly of the stacked paper tablets causing the tablet gripper tube 286 to slide upwardly while the hook 288 remains engaged with the uppermost tablet. "D" indicates the point at which the hook 288 stops after engaging a rearmost edge of the uppermost tablet prior to completing the vending cycle. The position shown at "D" indicates the uppermost tablet being shoved over the edge of the stack, engaging the tablet guide plate 312 and deflecting downwardly towards the inclined shelf 260. However, the arcuate shaped cam follower 292 keeps the tablet from falling over until the slidable portion of the handle 240 (shown in phantom lines) is slidably moved beyond the outer edge 234 of the coin receptor 202 to approximately the position shown as "d". Then the tablet drops to position "E" and then "F" and then to the inclined shelf 260 and finally to the lower shelf 258 where it can be retrieved through the tablet vending aperture 224 by the person.

Referring again to FIG. 8, "b" and "d" indicate the relative position of the slidable handle 240 during the extremes of the vending cycle and the corresponding position of the spring biased wire 300 as at b' and at d' respectively, as the spring biased wire 300 is urged to return to the ready-to-vend position.

A coin receipt box 318 disposed below the inner portion 240 of the slidable handle 228 rests on a coin box plate 320 for storage of the coins. The coin box plate 320 is rigidly attached to an innerside 314 of the front panel 206. The coins are removed from the coin receipt box 318 at the proper time when the service person services the machine 200.

Figure 9:
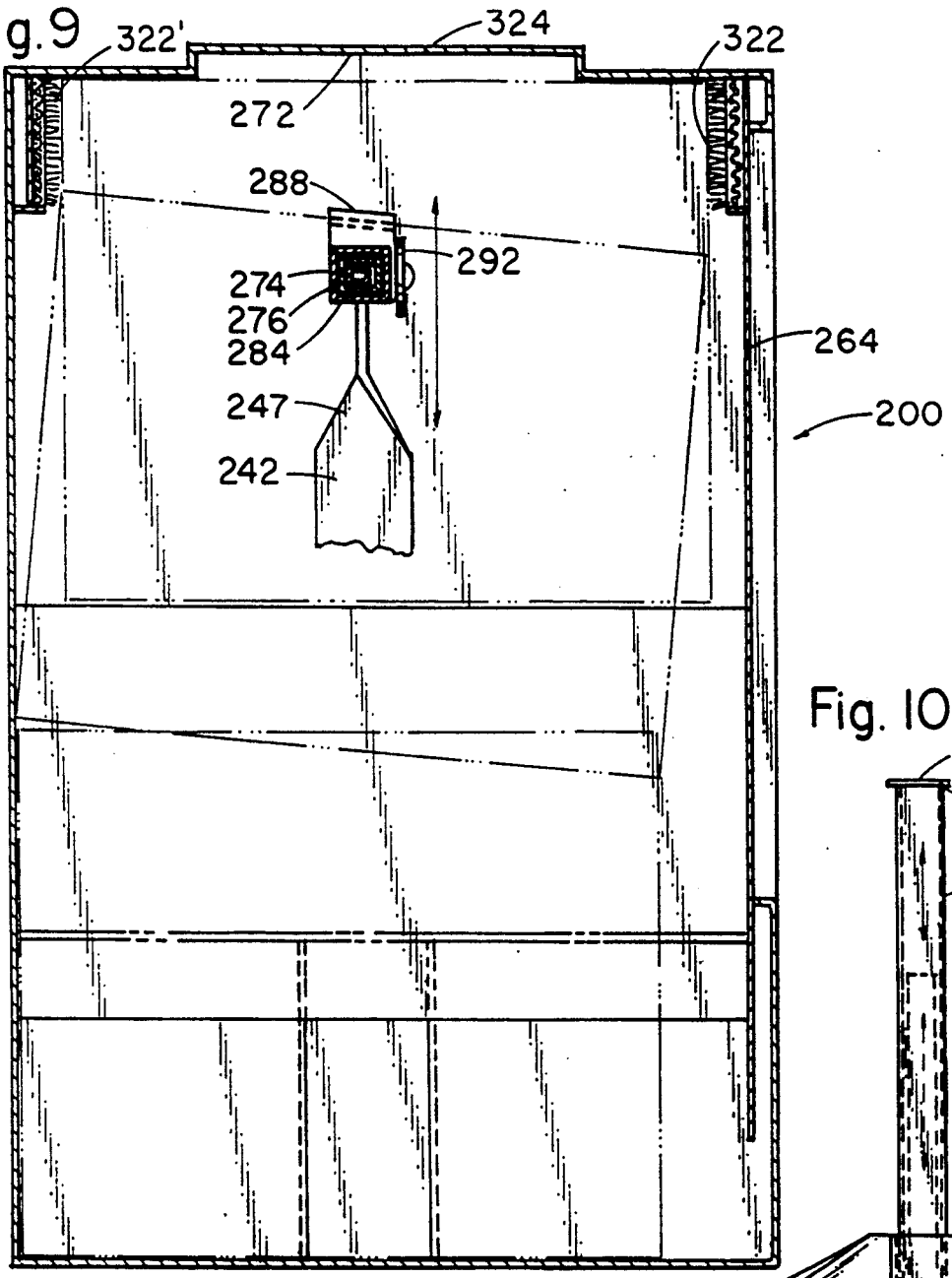
FIG. 9 is a compound cross sectional view along the lines 9—9 in FIG. 8.

As best seen in FIG. 9, the stack of tablets are constrained frictionally by a plurality of pads 322. The pads 322 being made of strips of carpeting or sponge rubber or foam rubber. The pads 322 hold the stacked tablets in the proper alignment at all times when the service person stacks the tablets in the machine 200. The flat bar stock 242 is rigidly attached to the tablet controller 250. The back panel 210 is adapted with an offset 324 to allow the hook 288 to project beyond the rearmost edge of the paper tablets in order to grip the uppermost tablet. Also, the hook 288 is slanted to urge the tablets to the left about 10 degrees. The slant urges the vended tablet to slidably communicate with the smooth left side panel 218 of the cabinet 204. This precludes the vended tablet from catching on the guide rail 262 on the right side of the tablet delivery slide 252.

Figure 10:
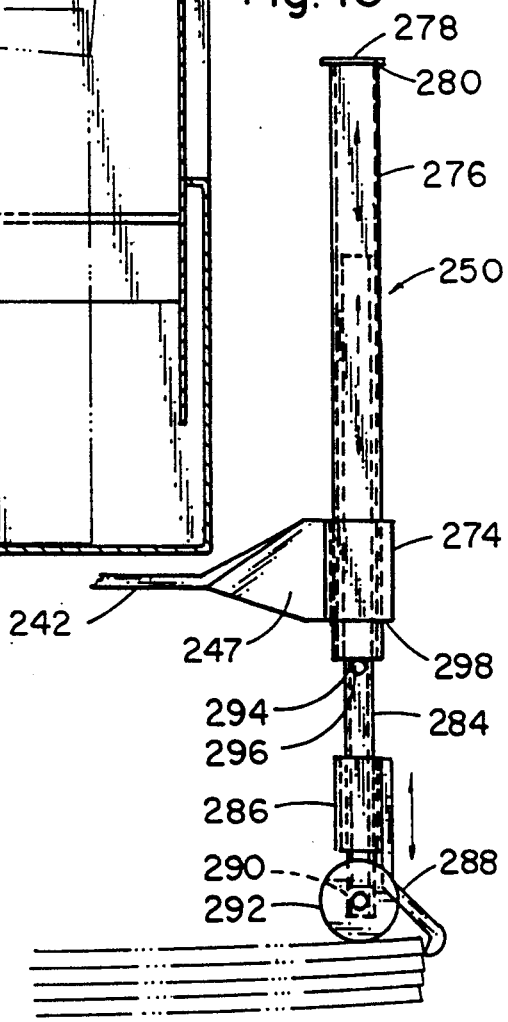
FIG. 10 is an enlarged view of the paper tablet controller.

FIG. 10 is an enlarged view for better understanding the motion of the hook 288 for engaging just one tablet at a time as shown in FIGS. 7 and 8. The arcuate shaped cam follower 292 rides the topside of the uppermost tablet while the hook 288 rides above and over the top of the stack and then drops down and engages the rearmost edge of the uppermost tablet.

In use and operation, the person utilizes the tablet vending machine 200 by pulling the slidable handle 228 forward slightly to expose the coin slot 230, 230', inserting the coin and slidably moving the handle 228 backward to urge the hook 288 to engage the rearmost edge of the uppermost tablet. Then, the person pulls the slidable handle 228 forward, thereby sliding the uppermost tablet from the stack and dropping it down onto the inclined shelf 260. The vending aperture 224 is configured so that even a child's hand can not go up the tablet delivery aperture 224 and steal tablets from the stack. Of course, the extra tablets stored on the base 316 behind the inclined shelf 260 and below the upper shelf 256 are inaccessible due to the fact that the inclined shelf 260 spans the width of the cabinet 204 to preclude any possibility of reaching under the upper shelf 256 from the tablet delivery aperture 224 to steal the extra tablets.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of structures and the combination and arrangement of parts may be resorted to without departing from the spirit and scope of the invention.

Now that the invention has been described,

What is claimed is:

1. A vending machine for dispensing paper tablets or the like comprising in combination:

A cabinet having a stepped front panel, a top panel, a rear panel, a left side panel, a right side panel and a base, the right side panel having a lockable, removable door for allowing restocking of the tablets in the interior of the cabinet thereof;

A coin receptor in an upper portion of the front panel having a flat elongate shape for receiving coins in an exterior sector thereof to initiate the vending of a tablet;

A tablet vending aperture in a lower portion of the front panel for allowing the person to retrieve the vended tablet;

A coin box shelf rigidly attached to an inner side of the upper portion of the front panel for holding a rectangular, removable coin box, the inner side of the upper portion of the front panel further having a tablet guide panel rigidly attached below the coin box shelf for urging the vended tablet toward the tablet vending aperture, the coin box positioned for receiving coins;

A tablet delivery tray having an upper shelf oriented horizontally in the lower portion of the cabinet thereof, and being rigidly attached to the interior wall of the rear panel and the left side panel for storing a plurality of unvended tablets in a stack, a lower shelf oriented horizontally in the lower portion of the cabinet thereof, and being rigidly attached tot eh interior wall of the front panel and the left side panel for storing a single vended tablet for allowing retrieval of the vended table through the tablet vending aperture, and an inclined shelf therebetween for urging passage of a single table therethrough;

Tablet dispensing control means in the interior of the cabinet thereof, for urging vending communication between the coin receptor and the tablet delivery tray;

Tablet dispensing control means for urging vending communication between the coin receptor and the tablet delivery tray;

A spring internally disposed within the cabinet with a first end coupled to a reward corner of the upper portion thereof, and a second end coupled to an interior end of the elongate coin receptor for urging the coin receptor rearwardly during the vending cycle; and A tablet dispensing controller having a plurality of tubes in an angular, telescoping, slidable relationship oriented vertically above the stack of unvended tablets, for engaging the topmost tablet and moving said tablet from the stack toward the inclined shelf.

2. A vending machine as recited in claim 1 wherein the tablet delivery tray further includes a guide rail rigidly attached to an edge thereof and vertically disposed for urging the vended tablet to the lower shelf.

3. A vending machine as recited in claim 2 wherein the tablet delivery tray still further includes a plurality of alignment pads for urging the stacked, unvended tablets to remain in a perpendicular orientation with respect to the tablet delivery tray.

4. A vending machine as in claim 1 wherein the tablet dispensing controller plurality of tubes further includes an outer tube having an elongate bar with a first end rigidly attached to an outer surface thereof, and a second end rigidly attached to an underside of the interior sector of the coin receptor, and an inner tube having an arcuate wheel coupled to a lower end for contacting the top unvended tablet in the stack, and an intermediate tube therebetween for urging annular telescopic communication between the plurality of tubes.

5. The vending machine as in claim 4 wherein the plurality of tubes has a rectangular cross-sectional shape.

6. A vending machine as in claim 5 wherein the inner tube of the tablet dispensing controller further includes a tablet gripper on a lower portion thereof oriented above the arcuate wheel for engaging a top surface of the unvended tablet in the stack, and for urging slidable forward motion of the unvended top tablet in the stack, the tablet gripper being in an annular telescopic relationship with the inner tube.

7. A vending machine as recited in claim 6 wherein the tablet gripper further includes a hook rigidly attached to an outer surface thereof, and downwardly disposed to engage a side of the top unvended tablet in the stack, the hook being downwardly disposed below the arcuate wheel about the thickness of a single tablet.

8. A vending machine as recited in claim 7 wherein the hook is angled leftwardly about between 5 to 15 degrees for urging the top unvended tablet in the stack to contact the left side panel of the cabinet during its traverse of the tablet delivery tray when the vending cycle is initiated.

9. A vending machine as recited in claim 4 wherein the intermediate tube has a horizontally oriented flat stop rigidly attached to an upper end thereof for restraining annular telescopic movement of the outer tube on the intermediate tube.

10. A vending machine as recited in claim 4 wherein the inner tube has an aperture adapted for receiving a fastener in the middle section thereof, for urging engagement with the intermediate tube when the full load of unvended tablets are loaded on the upper shelf of the tablet dispensing tray.

* * * * *